US005692837A

United States Patent [19]

Beer

[11] Patent Number: 5,692,837

[45] Date of Patent: Dec. 2, 1997

[54] GUSSETTED FLEXIBLE PACKAGE WITH RECLOSABLE MOUTH USING A SNAP TYPE RECLOSURE STRIP

[75] Inventor: Jeffrey Scott Beer, Perkiomenville, Pa.

[73] Assignee: Fres-co System USA, Inc., Telford, Pa.

[21] Appl. No.: 700,325

[22] Filed: Aug. 8, 1996

[51] Int. Cl.[6] ..... B65D 33/25

[52] U.S. Cl. ..... 383/61; 383/92; 383/120; 383/210

[58] Field of Search ..... 383/61, 210, 211, 383/15, 79, 86.1, 92, 120

[56] References Cited

U.S. PATENT DOCUMENTS

| | | | |
|---|---|---|---|
| 2,843,309 | 7/1958 | Wheeler | 383/79 X |
| 4,576,285 | 3/1986 | Goglio . | |
| 4,705,174 | 11/1987 | Goglio . | |
| 4,913,561 | 4/1990 | Beer . | |
| 4,988,216 | 1/1991 | Lyman | 383/86.1 X |
| 5,037,138 | 8/1991 | McClintock et al. | 383/61 X |
| 5,059,036 | 10/1991 | Richison et al. . | |
| 5,147,272 | 9/1992 | Richison et al. . | |

FOREIGN PATENT DOCUMENTS

| | | | |
|---|---|---|---|
| 6127557 | 5/1994 | Japan | 383/89 |
| 1008068 | 10/1965 | United Kingdom | 383/15 |

*Primary Examiner*—Jes F. Pascua

*Attorney, Agent, or Firm*—Caesar, Rivise, Bernstein, Cohen & Pokotilow, Ltd.

[57] ABSTRACT

A flexible, gussetted package and method of making it. The package has an interior for initially holding some product, e.g., whole coffee bean or ground coffee, under vacuum, and which includes a mouth portion arranged to be peeled open to provide access to the contents of the package. The package is formed of a flexible material and includes a front panel, a rear panel, and a pair of opposed side gussets. The panels and gussets each include a top portion, which between them define the package's mouth. A peelable closure is provided within the mouth. A snap closure is provided above the peelable closure. The package is arranged to be sealed under vacuum, with the peelable closure maintaining the vacuum within the package until it is peeled open. The snap closure comprises a pair of snap strip members secured to respective portions of the front and rear panel. The snap strip portions are arranged to be releasably snap fit together, so that they can be opened and reclosed after the peelable closure has been peeled open in order to provide repeated access to the interior of the package, while minimizing the ingress of air into the package when it is closed. The top portion of the package can be folded flat to enable it to be readily stacked after it is initially filled and sealed.

8 Claims, 3 Drawing Sheets

FIG. 3
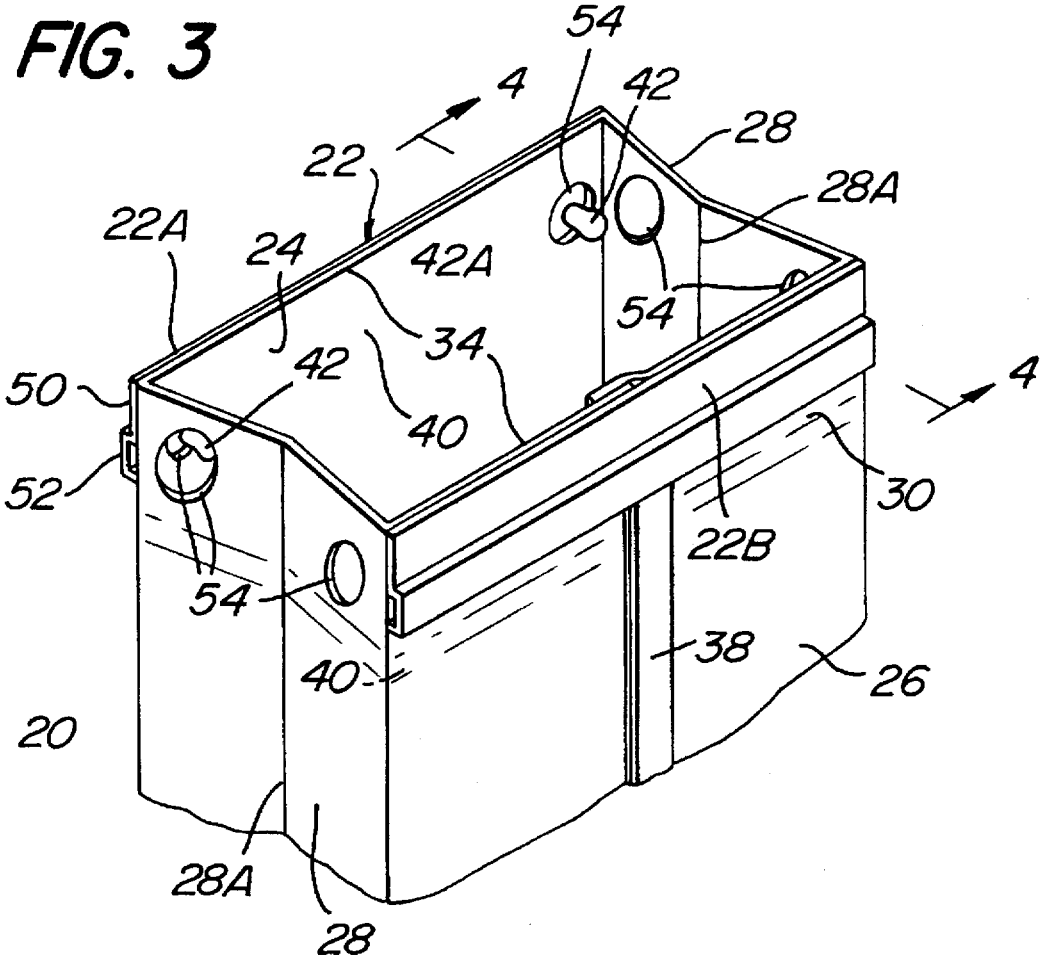
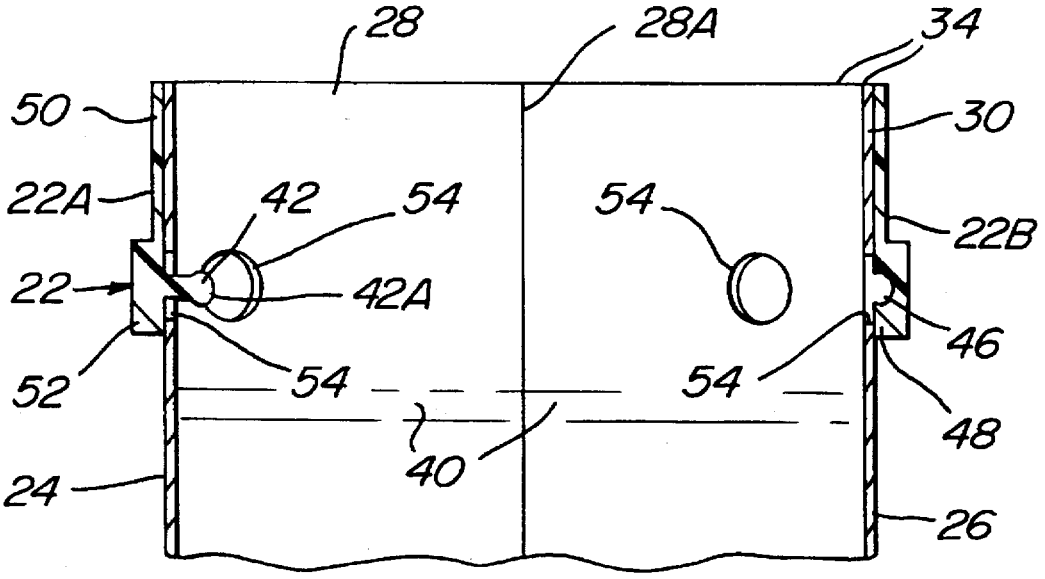
FIG. 4

GUSSETTED FLEXIBLE PACKAGE WITH RECLOSABLE MOUTH USING A SNAP TYPE RECLOSURE STRIP

BACKGROUND OF THE INVENTION

This invention relates generally to flexible packages, and more particularly to flexible packages for holding products, such as foods, under vacuum therein, and which once opened are arranged to be repeatedly re-opened and reclosed, while keeping the contents fresh.

Various types of flexible packages for holding particulate materials, e.g., ground or whole bean coffee, chemicals, etc., under vacuum therein have been disclosed in the patent literature and are commercially available today. Examples of such packages are found in the following U.S. Pat. Nos. 4,576,285 (Goglio), 4,705,174 (Goglio), and 4,913,561 (Beer).

The major advantages of flexible packaging, as compared to relatively rigid packaging, e.g., cartons, are that until the flexible package is filled it takes up very little volume, and after it is emptied of its contents it readily collapses, thereby reducing its volume to approximately that of the unfilled package. The former characteristic is a significant advantage insofar as storage is concerned, while the latter characteristic is a significant advantage from the standpoint of disposability.

One common type of flexible package for holding goods under vacuum until the package is opened is the so-called "gussetted" package or bag. Typically such a package is formed from a web of flexible stock material, e.g., polyethylene, polyester, polypropylene, metal foil, and combinations thereof in single or multiple plies, into a tubular body, having a face panel, a back panel, and a pair of gussetted sides. Each gussetted side is formed by a pair of gusset sections and a central fold edge interposed between a pair of outer fold edges. The lower end of the bag is commonly permanently sealed, e.g., heat sealed, along a line extending transversely across the width of the bag close to its bottom edge. The top of the bag is commonly sealed transversely across the entire width of the bag in a number of ways to maintain the contents under vacuum until the bag is opened. Such action is frequently accomplished via a readily openable mouth, which when opened provides access to the contents of the bag. For example, in one prior art package the top seal is made peelable by modifying the sealant layer with a peelable coating or incompatible additive. Thus, when the seal is peeled apart the unsealed portions form an open mouth through which the contents of the package may be removed. Another approach to providing an opening or mouth for a flexible package is that of the heretofore identified U.S. Pat. No. 4,705,174 (Goglio). That package includes a peel strip applied to the inner surface of the package below the top edges. The strip provides an air-tight interfacial seal which can be readily peeled apart to provide access to the interior of the package. Another approach to providing an opening or mouth for a flexible package is to score the upper flap of the package by laser or mechanical means through a tear initiation resistant layer(s) of the package structure. In this way the package can be opened by tearing away the scored area to form the package's mouth.

Gussetted bags, particularly those for foods, frequently make use of a plastic coated wire tie to serve as reclosure for the bag. In particular, the wire tie is designed to close the mouth of the bag after it has been initially opened so that the reclosed bag will keep its contents fresh. Whether or not such wire-tie reclosures effectively provide a positive means of reclosing a gussetted package is open to debate. Moreover, the effectiveness of such closures is frequently dependent upon the manner in which the wire tie is used. Thus, there is a perception in some quarters of the consuming public that a wire-tie package cannot be reclosed securely enough to maintain product freshness over an extended period of time. Therefore, such packages have not been fully accepted as being truly reclosable.

Non-gussetted flexible packages, such as stand-up pouches, are commercially available and typically include so-called "zipper-type" reclosures. Examples, of such packages are shown in U.S. Pat. Nos. 5,059,036 (Richison et al.), 5,147,272 (Richison et al.), and 5,147,272 (Richison et al.). These zipper-type closures are generally perceived by the consuming public as providing for a more effective reclosure of the flexible pouch after it has been initially opened than twist or wire tie closures. In fact, zipper-type closures may be more effective than wire-tie reclosures. At the very least they are easier to use, and not prone to loss or misplacement. Thus, stand-up, flexible pouches with zipper-type closures have gained wide acceptance by the consumer.

While the stand-up, zipper-closure type pouch offers advantages over a gussetted flexible package insofar as actual or perceived reclosability is concerned, its shape does not allow efficient use of case packing and retail shelf space, as does a gussetted package. In addition, the stand-up pouch cannot be stacked readily, if at all.

Thus, a need exists for a flexible package having the stacking and shape advantages of a gussetted package, but with the reclosability of a zipper-type closure stand-up package.

In my co-pending U.S. patent application, Ser. No. 08/690,271, filed on Jul. 19, 1996, entitled Gussetted Flexible Package With Reclosable Mouth Using Zipper Type Reclosure Strip, which is assigned to the same assignee as this invention and whose disclosure is incorporated by reference herein, there is disclosed and claimed a gussetted flexible package which addresses the needs of the prior art. That package has an interior for initially holding some product, e.g., whole coffee bean or ground coffee, under vacuum, and includes a mouth portion arranged to be peeled open to provide access to the contents of the package. The package is formed of a flexible material and includes a front panel, a rear panel, and a pair of opposed side gussets. The panels and gussets each include a top portion, which between them define the package's mouth. The top portion of the package at the mouth is flattened. A peelable closure and a zipper closure are provided in the flattened mouth of the package with the zipper closure located above the peelable closure. The zipper closure comprises a pair of strips which are releasably secured to each other. In particular, one of the strips extends across and is fixedly secured to the inner surface of the package at the top end the full width of the front panel and one half of each of the gussets on either side of the front panel. The other of the strips extends across and is fixedly secured to the inner surface of the package at the top end thereof the full width of the rear panel and the other half of each of the gussets on either side of the rear panel. The package is arranged to be sealed under vacuum, with the peelable closure maintaining that vacuum within the package until it is peeled open. The zipper closure is arranged to be opened and reclosed after the peelable closure has been peeled open in order to minimize the ingress of air into the package. The package includes a top portion which can be folded into a flap and flattened to enable the package to be readily stacked.

In my co-pending U.S. patent application, Ser. No. 08/694,375, filed contemporaneously herewith, entitled Gussetted Flexible Package With Reclosable Mouth Using Zipper Type Reclosure Strip Located Above The Mouth, which is assigned to the same assignee as this invention and whose disclosure is incorporated reference herein, there is disclosed and claimed a gussetted flexible package which also addresses the needs of the prior art. That package is similar in construction to the package of my aforementioned copending application entitled Gussetted Flexible Package With Reclosable Mouth Using Zipper Type Reclosure Strip, except that the top end portion of the package forming the mouth is not flattened, and the zipper closure extends only the width of the front and rear panels. In particular, one of the strips extends across the top portion of one of the panels (but not to the gussets) above the peelable seal and is fixedly secured thereto. The other strip extends across the top portion of the other of the panels (but not to the gussets) and is fixedly secured thereto. The strips are arranged to be releasably secured to each other to temporarily close the package's mouth after the peelable closure is opened, whereupon the zipper closure eliminates or minimizes the ingress of air into the package to protect any material therein while being readily openable to provide access to that material through the package's mouth. The top portion of the package can be folded into a flap and then flattened to enable the package to be readily stacked.

While the inventions of my aforementioned patent applications are suitable for their intended purposes, a need still exists for other gussetted packages which have the stacking and shape advantages of such packages, but with the reclosability of a zipper-type closure stand-up package, yet which do not use zipper type closures.

OBJECTS OF THE INVENTION

Accordingly, it is a general object of this invention to provide another gussetted flexible package which addresses the needs of the prior art.

It is a further object of this invention to provide a gussetted flexible package which includes a snap closure.

It is a further object of this invention to provide a gussetted flexible package with a snap closure which is simple in construction.

It is a further object of this invention to provide a gussetted flexible package which includes a snap closure and which is low in cost.

It is a further object of this invention to provide a gussetted flexible package which includes a snap closure and which can be manufactured easily.

It is a further object of this invention to provide a gussetted flexible package which includes a snap closure and which is easy to use.

It is a further object of this invention to provide a gussetted flexible package which includes a snap closure and which can be readily stacked.

SUMMARY OF THE INVENTION

These and other objects of the instant invention are achieved by providing a flexible, gussetted package having an interior for holding some material, e.g., whole bean coffee, ground coffee, etc., therein. The package is formed of a flexible material and comprises a front panel and a rear panel connected to each other by respective side gussets. Each of the panels and gussets has an upper end portion which conjoin to form a mouth for the package. The upper end of the package at the mouth is of the width of the panels.

The package additionally comprises a first and second closure means located adjacent the package's mouth. The first closure means, e.g., a peelable closure, is located within the package's mouth and is arranged for sealing the interior of the package until its mouth is opened. The second closure means is located above the first closure means and comprises a pair of snap strip members releasably secured to each other. One snap strip member extends across the top portion of one of the panels and is fixedly secured thereto. Similarly, the other snap strip member extends across the top portion of the other of the panels and is fixedly secured thereto. The snap strip members are arranged to be releasably snapped together to temporarily close the package's mouth after the first closure means is opened, whereupon the second closure means eliminates or minimizes the ingress of air into the package to protect any material therein, while being readily openable to provide access to that material through the mouth.

DESCRIPTION OF THE DRAWING

FIG. 3 is a view similar to FIG. 2 but showing the package after it has been fully opened;

FIG. 4 is an enlarged sectional view taken along line 4—4 of FIG. 3;

DETAILED DESCRIPTION OF THE PREFERRED EMBODIMENT

Figure 1:
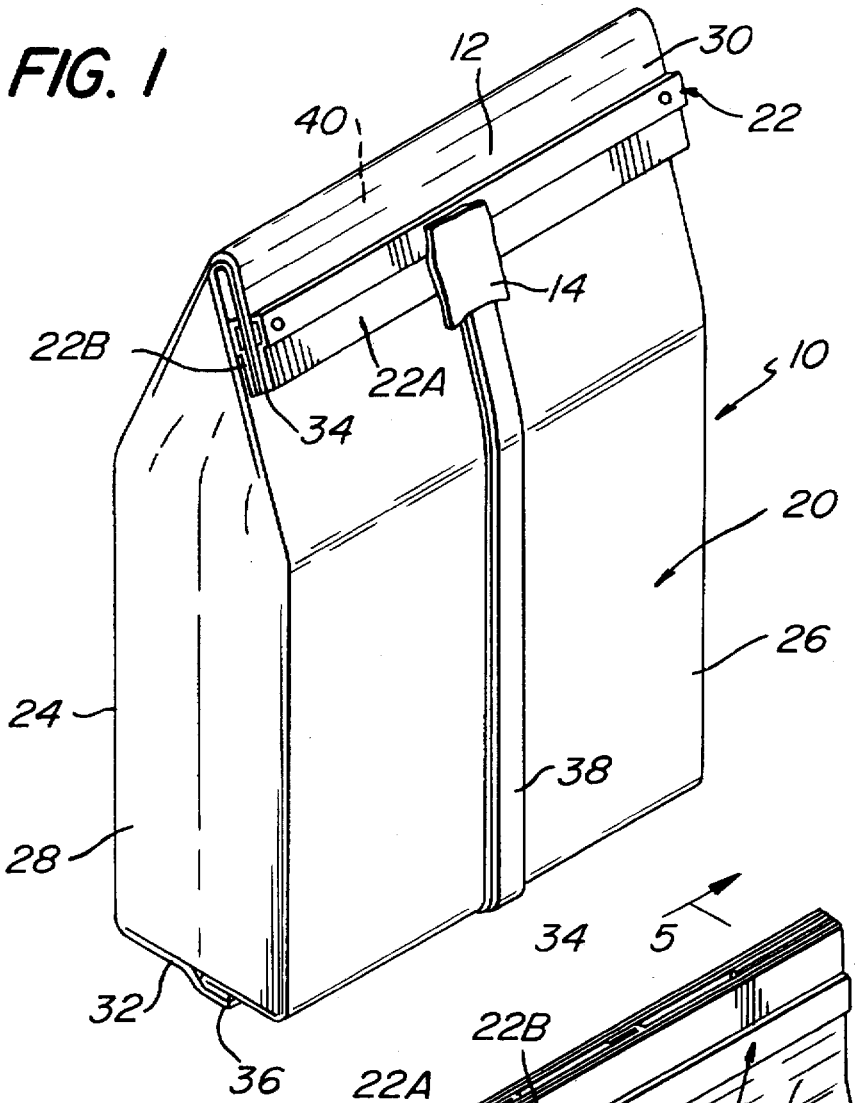
FIG. 1 is an isometric view of a gussetted flexible package constructed in accordance with this invention and shown in its condition as initially sealed.

Referring to FIG. 1, there is shown at 10 in FIG. 1 a flexible package constructed in accordance with this invention. The package basically comprises a gussetted bag 20 and a resealable closure 22. The bag 20 is arranged to hold any material, e.g., coffee beans, ground coffee, chemicals, etc., for dispensing, e.g., pouring, therefrom. The bag or package 20 is formed of a web of any suitable, flexible material in a manner to be described hereinafter.

Turning now to FIGS. 1–4 it can be seen that package 20 basically comprises a front wall or panel 24 (FIGS. 3 and 4), a rear wall or panel 26 (FIGS. 1–4), a pair of identical gussetted sides 28 (FIGS. 3 and 4), a top end portion 30, and a bottom end portion 32. The top end portion 30 of the package terminates in a top marginal edge 34 (FIGS. 1–4). In a similar manner the bottom end portion 32 (FIG. 1) of the package terminates in a bottom marginal edge 36 (FIG. 1). If desired, an a one-way venting valve (not shown) may be included in any suitable portion of the package to enable gases which may be produced by the material(s), e.g., coffee, contained within the sealed package to vent to the ambient air without air gaining ingress to the package's interior.

The front panel 24, rear panel 26, and the two gussetted sides 28 of the package are all integral portions of a single sheet or web of the flexible material, of single or multiple ply or layers, which has been folded and seamed to form a tubular body. One particularly useful flexible material for the package 20 is a laminated web of flexible packaging material commercially available from Fres-Co System USA, Inc., of Telford Pa., the assignee of this invention. That material comprises a 48 gauge polyester layer, ink, an adhesive layer, a 28 gauge aluminum foil layer, another adhesive layer, a 60 gauge nylon layer, another adhesive layer, and a 300 gauge easy open sealant layer. When a web of such material is formed into the tubular body for the package the polyester layer serves as the outer surface of the package, with the easy-open sealant layer being the inner surface of the package.

As can be seen clearly in FIGS. 1–3 and 6, the rear panel 26 of the package 20 includes a fin 38 which extends longitudinally along the back of the package from the top edge to the bottom edge. The fin 38 is located approximately midway between the gussetted sides 28 and is formed by portions of the web material contiguous with the vertical marginal edges of the sheet or web which are brought into engagement with each other and are secured to one another via any conventional sealing technique, such as heat sealing or welding. The resultant fin or seam 38 is generally folded down so it lays substantially flush with the rear wall 26 of the package.

As can be seen clearly in FIGS. 1–4, the closure 22 is located in the top end portion 30 of the package. The details of the closure 22 will be described later. Suffice it for now to state that the closure extends across the width of the package's panels 24 and 26, with portions secured on the inner surface thereof immediately below the package's top edge 34.

The package 20 is arranged to be initially hermetically sealed closed along a transverse, peelable seal line 40 (FIGS. 1–3), after it has been filled and vacuumized. The seal line 40 is formed in a conventional manner and extends across the width of the package 20 slightly below the closure 22 and seals the inner surfaces of the abutting front and rear panels to each other between the inner fold lines 28A of the pair of gussets 28, while sealing the outer marginal portions of the front panel 24 to the portions of the gussetted sides contiguous therewith, while also sealing the outer marginal portions of the rear panel 26 to the portions of the gussetted sides contiguous therewith, as is conventional. Thus, the peelable seal line 40 serves to isolate the contents of the package from the ambient atmosphere once it is sealed. The peelable seal line 40 is formed by the appropriate heat sealing of the abutting easy-open sealant layer portions forming the inner surface of the package 20. Alternatively, the seal line 40 can be formed in any other conventional manner, e.g., the use of peelable sealing strips like that disclosed in the aforementioned Goglio patents, whose disclosures are incorporated by reference herein.

The lower or bottom end 32 of the package is sealed closed along a transverse, permanent seam line closely adjacent the bottom edge 36. The permanent seam line is formed using any conventional sealing technique, such as that used for the vertical seamed fin 38.

When the package 20 is filled, vacuumized, and sealed its contents, e.g., whole bean coffee (not shown), will be kept isolated from the ambient air by the seal line 40. The closure 22 is also closed at this time and the top portion 30 of the package with the closure secured thereto is folded down to form a flap 12 such as shown in FIG. 1. The Flap 12 is held in place by a strip of adhesive tape 14. In order to gain ingress into the package so that some or all of its contents can be removed, the tape 14 is removed and the flap unfolded to the position shown in FIG. 2. The closure 22 portions contiguous with the top marginal edges 34 of the package are grasped and pulled apart (as will be described in detail later). This action unsnaps the closure, i.e., separates its two components strips (to be described later), and also peels open the seal line 40 to form the mouth of the package as shown in FIG. 3. The contents of the package can then be poured or otherwise removed through the package's mouth.

Figure 2:
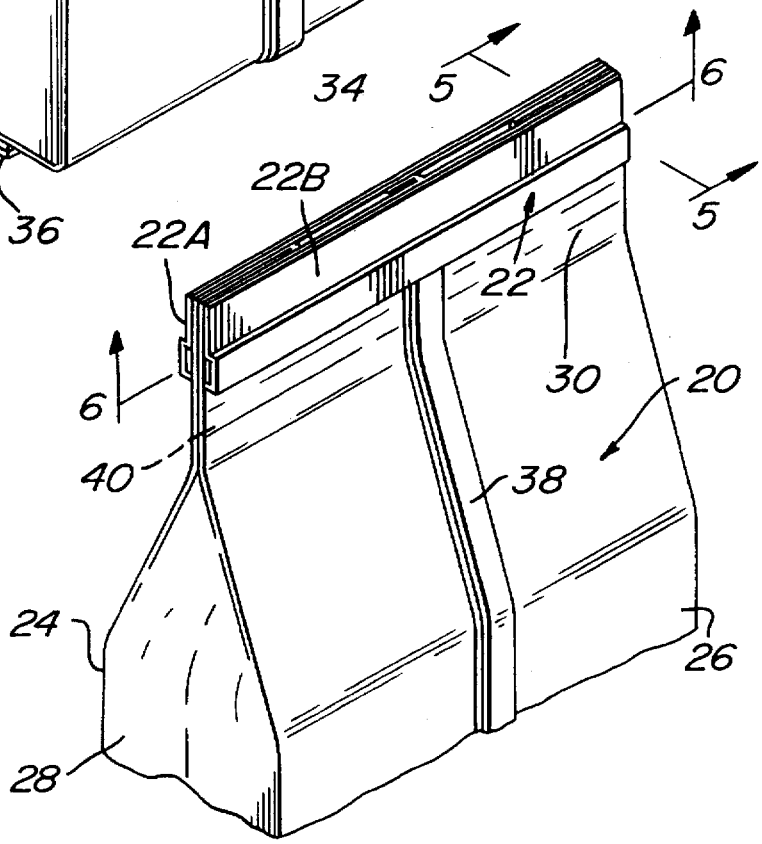
FIG. 2 is a view of the top portion of the package of FIG. 1 but showing an initial step in the opening of the package.

The closure 22 also serves as the means to enable the mouth of package to be reclosed after some of the package's contents have removed and it is desired to keep the remaining contents fresh, i.e., generally isolated from the ambient atmosphere. The closure 22 is best seen in FIG. 2 and comprises a pair of snap strips 22A and 22B which are arranged to releasably mate with each other. Each of the strips is formed of a plastic material, e.g., high or low density polyethylene or polypropylene or some other material which is slightly flexible to enable it to be bent out of its original shape by the application of force thereto, but which returns to its original shape after removal of that force. Each strip extends the width of the panel to which it is secured and are of generally similar construction. Thus, the strips 22A and 22B each include a top edge or grasping portion 50 and a bottom edge or mounting portion 52. Each strip is arranged to be fixedly secured, e.g., welded or permanently adhesively secured to the inner surface of the top portion of the respective panel of the package 20 immediately below the top edge 34 and across the full width of the strip.

The strip 22A includes a pair of prongs or projections 42 which project perpendicularly upward from respective planar bases 44 (FIG. 6) located within the channel shaped bottom portion 52 adjacent each end of the strip 22A. Each of the prongs is cylindrical and terminates in a slightly bulbous free end or tip 42A (FIGS. 3–6). The strip 22B includes a pair of wells or recesses 46 corresponding in shape and size to the bulbous tips 42A of the prongs for receipt thereof. Each of the wells 46 is located within a respective planar base 48. The planar bases 48 are located within the channel shaped bottom portion 52 of the strip 22B adjacent the ends thereof. The spacing between the wells 46 is the same as the spacing between the prongs 42.

Figure 5:
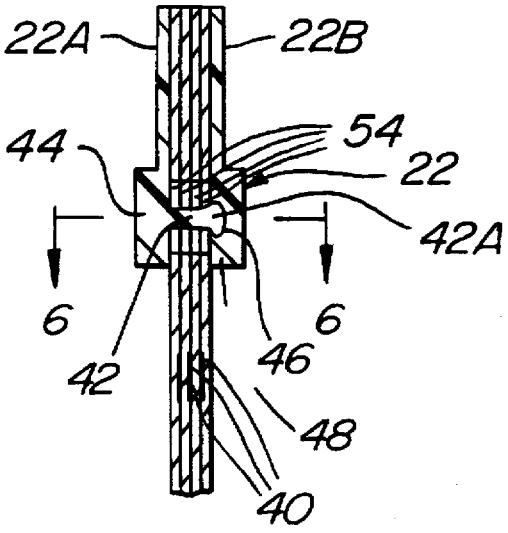
FIG. 5 is an enlarged sectional view taken along line 5—5 of FIG. 2.
Figure 6:
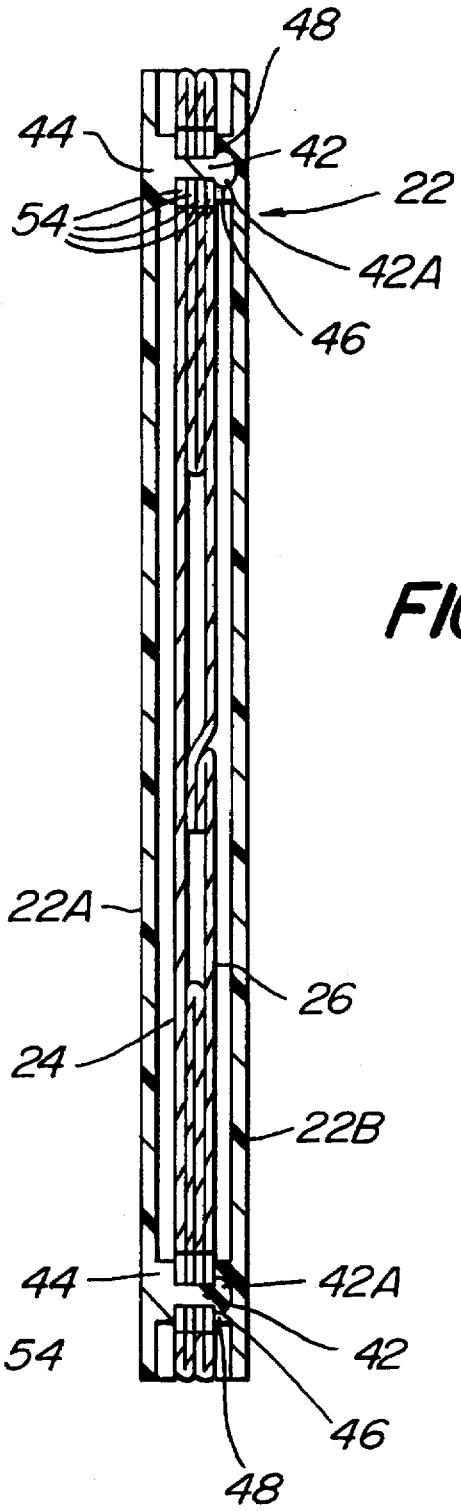
FIG. 6 is an enlarged sectional view taken along line 6—6 of FIG. 2.

As can be seen in FIGS. 5 and 6, the top portions of the package on each side of the front panel 24, on each side of the rear panel 26, and within the gussets, include holes 54. When the package is sealed shut these holes 54 are aligned with one another so that the pair of prongs 42 of the strip 22A can extend through the aligned holes 54 in the panels and the gussets 28 to snap fit within the pair of wells in the strip 22B. Thus, the holes prevent the material forming the package from interfering with the prongs snap fitting into the wells to thereby snap fit the strips 22A and 22B together.

The material forming the strips is somewhat elastic to enable the bulbous tips of the prongs to snap into the respective wells, and to be locked therein against accidental disconnection, yet which enable the bulbous tips of the prongs to exit the wells when the strips are pulled apart. Notwithstanding their slight elasticity, the strips are substantially rigid so that when they are snapped together the portion of the strip 22A between the prongs 42 serves to hold the top portion of the front panel 24 tightly against the top portion of the rear panel and with the side gussets interposed therebetween while the portion of the strip 22B between the wells 46 serves to hold the top portion of the rear panel tightly against the top portion of the front panel and with the side gussets interposed therebetween. The channel shaped lower portions 54 of the strips 22A and 22B tend to reinforce the strips and keep them linear to further ensure that the mouth of the package is sealed closed when the strips are snap connected to each other. Thus, when the strips 22A and 22B are snapped together the contents of the bag 20 are effectively isolated from the ambient surroundings so that they can be kept fresh over an extended period of time.

The closure 22 can be readily opened by snapping apart the two strips 22A and 22B. In order to accomplish that action the strips 22A and 22B include the heretofore identified grasping portions 50. Since the strips are somewhat flexible and resilient, the user of the package can readily grasp the middle of the top edge portion 50 of the strip 22A between his/her thumb and forefinger of one hand and the middle of the top edge portion 50 of the strip 22A between his/her thumb and forefinger of the other hand. Once that has been accomplished the user can readily pull the strips apart, to unsnap the closure, i.e., to cause the prongs to snap out of the wells.

The package can be reclosed to seal its remaining contents therein by merely bringing the strips 22A and 22B together and squeezing their end portions together to cause the prongs to snap into their respective wells. The flap 12 can then be folded down and the adhesive tape 14 reapplied to hold the flap in place.

In order to enable a bag of this invention to be readily stacked on other similar bags after it is initially filled and hermetically sealed by seal line 40, its upper or top portion 30 can be folded over itself to form the flap, with the flap 12 being adhesively secured to the underlying portion of the bag by the tape strip 14. The flap 12 and underlying portion of the bag can then be folded down and disposed on the remaining contiguous portion of the bag by the tape strip. The flap and underlying portion of the package can then be folded down and disposed on the remaining portion of the package to form a flat top surface for the bag. This action effectively "squares" the top of the bag so that the bag has a brick-like shape. Thus, the resulting package is brick-like in shape and can be readily stored and stacked. In order to enable the package to be readily opened the adhesive strip 58 is removable.

As should be appreciated from the foregoing the subject invention provides a new means of reclosing a flexible package having side gussets, in the interest of consumer acceptance.

As should be appreciated from the foregoing the subject invention provides a new means of reclosing a flexible package having side gussets, in the interest of consumer acceptance.

Without further elaboration the foregoing will so fully illustrate my invention that others may, by applying current or future knowledge, adopt the same for use under various conditions of service.

I claim:

1. A package having an interior for holding material therein, said package being formed of a flexible material and comprising a front panel and a rear panel connected to each other by respective side gussets, each of said panels and said gussets having an upper end portion which conjoin to form a mouth for said package, said package additionally comprising first and second closure means located adjacent said mouth, said first closure means being arranged for sealing the interior of the package until said first closure means is opened to open said mouth, said second closure means comprising a first elongated snap strip member and a second elongated snap strip member, said snap strip members being arranged to be releasably snap fit to each other, one of said snap strip members extending across said top portion of one of said panels and being fixedly secured thereto, said other of said snap strip members extending across said top portion of the other of said panels and being fixedly secured thereto, said snap strip members being arranged to be releasably secured to each other to temporarily close said mouth after said first closure means is opened, whereupon said second closure means eliminates or minimizes the ingress of air into said package to protect any material therein while being readily openable to provide access to such material through said mouth, each of said snap strip members including a channel shaped portion extending across the entire width thereof and a generally planar top tab portion projecting upward from said channel shaped portion generally parallel to said panels and forming the top edge of said package, said top tab portions being arranged to be gripped to unsnap said strips from each other, said channel shaped portions enhancing the rigidity of said strip.

2. The package of claim 1 wherein said first closure means is peelable.

3. The package of claim 1 wherein each of said snap strip members is elongated and has a pair of ends, said second closure means additionally comprising a pair of projections located adjacent said ends of one of said snap strip members, and a pair of recesses located adjacent said ends of said other of said snap strip members for receipt of respective ones of said projections, and wherein said package includes openings in said side gussets through which said projections extend when said snap strip members are secured to each other.

4. The package of claim 3 wherein said package also includes openings in said front and rear panels through which said projections extend when said snap strip members are secured to each other.

5. A package having an interior for holding material therein, said package being formed of a flexible material and comprising a front panel and a rear panel connected to each other by respective side gussets, each of said panels and said gussets having an upper end portion which conjoin to form a mouth for said package, said package additionally comprising first and second closure means located adjacent said mouth, said first closure means being arranged for sealing the interior of the package until said first closure means is opened to open said mouth, said second closure means comprising a first elongated snap strip member and a second elongated snap strip member, said snap strip members being arranged to be releasably snap fit to each other, one of said snap strip members extending across said top portion of one of said panels and being fixedly secured thereto, said other of said snap strip members extending across said top portion of the other of said panels and being fixedly secured thereto, said snap strip members being arranged to be releasably secured to each other to temporarily close said mouth after said first closure means is opened, whereupon said second closure means eliminates or minimizes the ingress of air into said package to protect any material therein while being readily openable to provide access to such material through said mouth, each of said snap strip members being elongated and having a pair of ends, said second closure means additionally comprising a pair of projections located adjacent said ends of one of said snap strip members, and a pair of recesses located adjacent said ends of said other of said snap strip members for receipt of respective ones of said projections, and wherein said package includes openings in said side gussets through which said projections extend when said snap strip members are secured to each other.

6. The package of claim 5 wherein said package also includes openings in said front and rear panels through which said projections extend when said snap strip members are secured to each other.

7. The package of claim 5 wherein said first closure means is peelable.

8. The package of claim 5 wherein each of said strips is linear and is formed of a material which tends to keep it linear but which enables said intermediate portions of said strips to be bent to enable one to grasp such intermediate portions to unsnap said projections from said recesses.

* * * * *